United States Patent [19]

Kückens et al.

[11] 4,011,733

[45] Mar. 15, 1977

[54] APPARATUS AND PROCESS FOR CARBONATING LIQUIDS

[75] Inventors: Alexander Kückens, Hamburg; Horst Köhl, Reinfeld, both of Germany

[73] Assignee: DAGMA GmbH & Co., Reinfeld, Germany

[22] Filed: July 29, 1975

[21] Appl. No.: 600,063

[52] U.S. Cl. ..... 62/59; 62/139; 62/308

[51] Int. Cl.[2] ..... F25D 11/00

[58] Field of Search ..... 62/139, 308, 59, 394, 62/138; 261/DIG. 7

[56] References Cited

UNITED STATES PATENTS

| | | | |
|---|---|---|---|
| 2,241,018 | 5/1941 | Lloyd | 261/DIG. 7 X |
| 2,418,994 | 4/1947 | Taylor | 62/394 |
| 2,514,463 | 7/1950 | Bayers, Jr. | 261/DIG. 7 X |
| 2,632,308 | 3/1953 | Engelhardt | 62/139 |
| 2,724,950 | 11/1955 | Rothwell | 62/139 |
| 2,973,630 | 3/1961 | Kriechbaum | 62/139 |
| 3,552,136 | 1/1971 | Cook | 62/139 |
| 3,726,102 | 4/1973 | Parrs | 261/DIG. 7 X |
| 3,898,856 | 8/1975 | Komedera | 62/139 X |

*Primary Examiner*—William E. Wayner
*Assistant Examiner*—William E. Tapolcai, Jr.
*Attorney, Agent, or Firm*—Michael J. Striker

[57] ABSTRACT

An apparatus and a process for carbonating liquids, has inlet pipes for admitting a carbonating gas and a liquid into a container and outlet pipes for dispensing the carbonated mixture from the container. Cooling coils are provided in the container for forming an interior and an exterior surrounding ice layer so that the mixture can come into thermal contact with at least the interior ice layer and be cooled thereby. Electrodes are provided for preventing the thickness of at least the interior ice layer from exceeding a predetermined value.

22 Claims, 2 Drawing Figures

APPARATUS AND PROCESS FOR CARBONATING LIQUIDS

BACKGROUND OF THE INVENTION

It is well known in the art of carbonating beverages that the solubility of $CO_2$ in liquid will increase by increasing the pressure and/or by decreasing the temperature of the mixture. The most favorable temperature conditions to achieve the so-called carbonation effect is in the temperature range between 0° C and 1° C. As the temperature increases, the solubility of the $CO_2$ decreases since the gas bubbles will grow larger and leave the liquids, thus making the taste of that beverage less desirable. Hence, the desirability of subjecting and maintaining the liquid at low temperatures is evident.

One typical prior art approach involves providing a container for mixing the mixture of carbonating gas and liquid and another separate container for cooling the mixture. Such pre-cooling arrangements utilize pipes to transport the cooled liquid to the carbonation chamber which result in unavoidable thermal energy losses. This loss in cooling energy means that it is very difficult and very expensive to maintain the liquid at temperatures in the region between 0–1° C for the entire piping system of the pre-cooling arrangement, and, in fact, virtually impossible to continuously maintain such a temperature range.

Another problem inherent in such pre-cooling systems which require separate containers is that the pipes are rather prone to clogging due to ice blockage.

Evaporator plates or tubes are generally used in such pre-cooling arrangements and form ice having thicknesses on the order of 10 millimeters in order to store great quantities of cooling energy. Ice having a high specific heat makes a very efficient storehouse or reserve for cooling energy.

It is known that, in nature, an ice layer having a low conductivity to differences in temperature will protect certain flowers and animals from the deleterious effects of the cold. The thicker the ice layer is, the more cooling energy can be retained, and the better the ice layer is at isolating the things to be protected from the effects of the cold.

In the art under discussion, such thick ice layers therefore do not interchange cooling energy with liquid, such as tap water having a relatively warmer temperature than the ice layer, quickly enough to make mass production of such carbonated beverages feasible and economical. Hence, the temperature in the carbonation devices of the prior art invariably rises and continuously worsens the so-called carbonation effect.

Moreover, the increase in temperature of the prior art devices not only negatively influences the carbonation effect, but also produces a relatively warmer beverage. Since the preferred temperature of such drinks is cold, it will be seen that such beverages are not desired if one quickly taps the beverage from the mixing container.

Other prior art approaches involve pressurizing the liquid during its mixing with the gas, pressurizing the beverage during transportation, and maintaining the pressurizing condition at the point of distribution, e.g. in a soda-vending mahine. Using such pressure techniques, a high amount of the carbonic acid — which gives the beverage its flavor — will be lost because of the foam produced.

SUMMARY OF THE INVENTION

Accordingly, it is a general object of the present invention to overcome the disadvantages of the prior art.

More particularly, it is an object of the present invention to provide an improved apparatus and an improved process for carbonating liquids efficiently.

Another object of the present invention is to provide a single container wherein cooling and mixing can occur, thus eliminating pre-cooling arrangements which lose cooling energy.

Another object of the present invention is to provide a single container wherein cooling and mixing can occur, thus eliminating pre-cooling arrangements which are subject to clogging.

Yet another object of the present invention is to improve the carbonation efficiency and improve the thermal exchange between the cooling arrangement and the mixture by providing a smooth-running mixer which creates no unnecessary turbulence.

Still another feature of the present invention is to improve the thermal exchange between the cooling arrangement and the mixture by controlling the thickness of the ice layers formed about the cooling arrangement.

In keeping with these objects and others which will become apparent hereinafter, one feature of the present invention resides in providing cooling means in a container which is operative for forming an interior and an exterior ice layer. Carbonating gas and a liquid are both admitted into the container so as to be mixed therein and thereby to come into thermal contact with, and be cooled by, at least the interior ice layer. Means for dispensing the mixture and means for preventing the thickness of at least the interior ice layer from exceeding a predetermined thickness are also provided.

These features overcome the prior art disadvantages and achieve the above-mentioned objectives in a novel manner, for the carbonation and the simultaneous cooling effect no longer occur in separate containers but in a single container. Thus, the container of the present invention need not be supplied with any precooled liquid so that the continuous operation of the apparatus will not be stopped by clogging, and the cooling energy losses will be minimized. By placing the cooling means directly in the container, a better cooling energy exchange with the mixture is realized and, of course, the space required by the apparatus is substantially reduced.

The thicknesses of the interior and the exterior ice layers which surround the cooling means are carefully controlled so that each will perform a particular function. The interior ice layer is maintained relatively thinner than the exterior ice layer so that the interior ice layer stores a proportionately small amount of cooling energy but makes possible a quick and efficient interchange of thermal energy with the mixture. The relatively thicker exterior ice layer assumes the primary task of storing cooling energy, and the high specific heat characteristic of the exterior ice layer actually serves to isolate the mixture located in the interior central region of the container. The mixture is thus protected from losing thermal energy to the outside of the container.

Because of the locations of the interior and exterior ice layers, the interior ice layer is always thinner than the exterior ice layer inasmuch as the interior ice layer is constantly exposed to the warming action of the relatively warmer mixture. In other words, the temperature difference at the outer surface of the interior ice layer with the mixture is greater as compared with the outer surface of the exterior ice layer.

In order to increase the thermal exchange, a magnetically-driven stirrer is located at the bottom of the container. The effect is analogous to a blower unit which blows a fluid medium onto an evaporator whereby the freezing effect is improved. The stirrer has blades and is driven in a slow gentle manner so as not to cause any turbulence in the mixture. Such turbulence will cause the relatively smaller gas bubbles introduced into the chamber to expand and unite with neighboring bubbles to form even larger bubbles. The larger the gas bubbles, the greater the tendency that the gas will rise to the surface of the liquid and escape therefrom.

Another feature of the invention is to utilize pipes or tubing and shape it into annular coils, preferably in a helicoidial configuration. The cooling surface area is thus increased.

Another feature of the present invention is to provide a safety electrode in the container in the exterior region. The safety electrode prevents the exterior ice layer from exceeding a pre-selected thickness which would otherwise destroy the container.

Still another feature is that the traces of carbonic acid dissolved in the mixture will be frozen to a large extent. This feature favorably influences the taste and the temperature of the finished beverage.

In summary, the present invention makes use of the specific heat characteristic of ice and uses it to store a relatively large reserve of cooling energy in the exterior ice layer. The present invention further adjustably controls the thickness of the relatively thinner interior ice layer to any desired predetermined value in order to promote thermal exchange. The present invention further improves the conduction and convection effect by utilizing a mixing arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
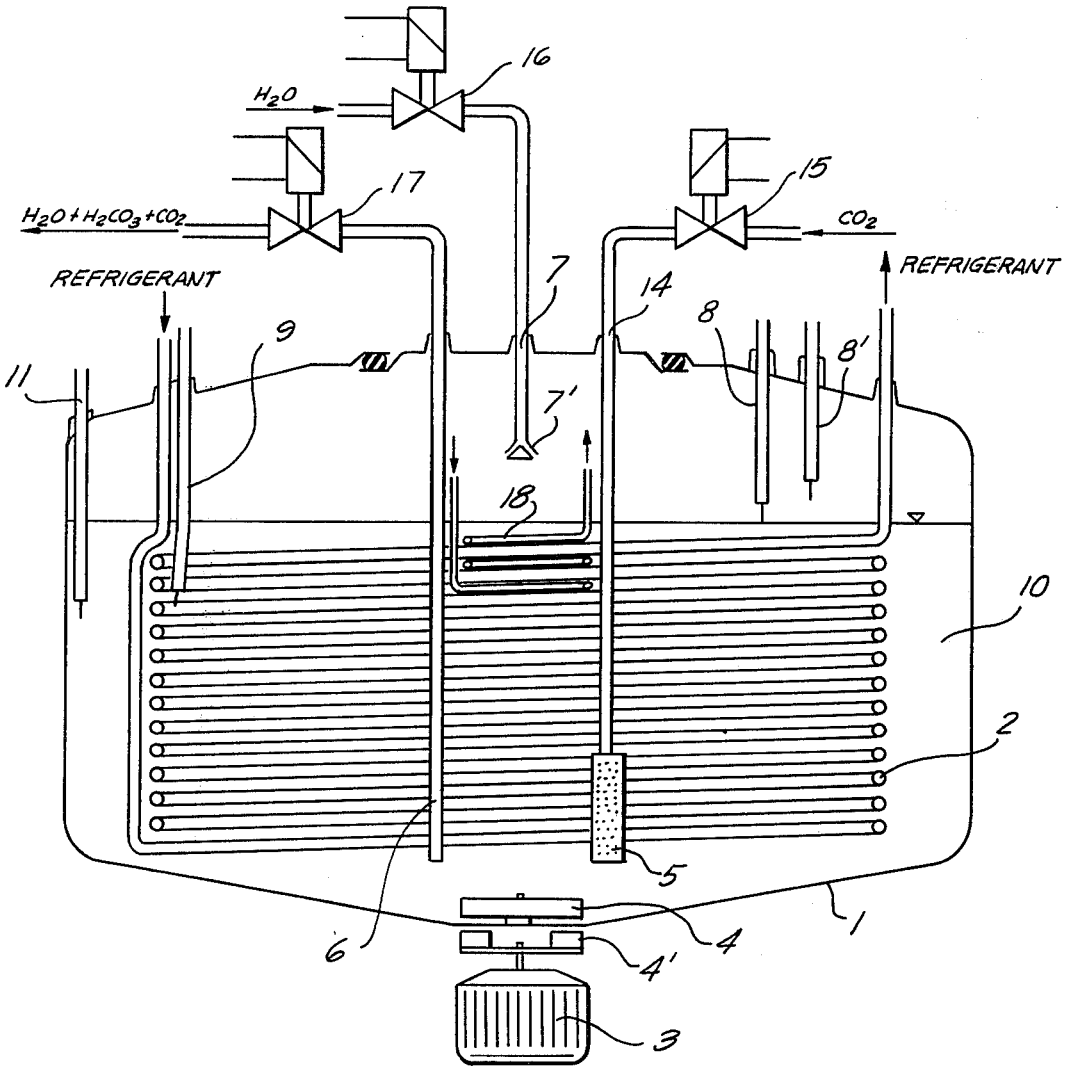
FIG. 1 is a diagrammatic view of an apparatus according to the present invention.
Figure 2:
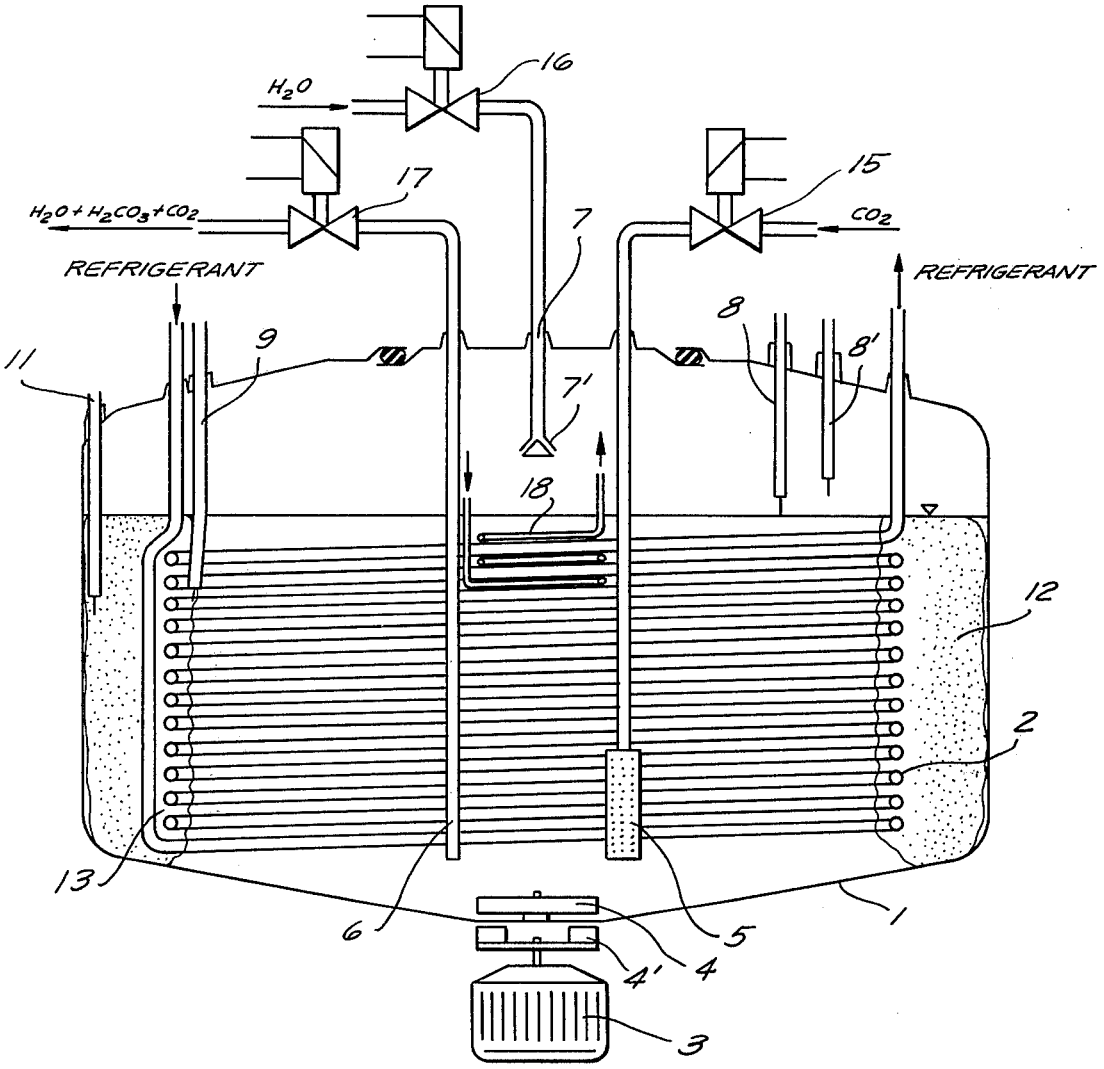
FIG. 2 is a diagrammatic view of FIG. 1 showing the formation of ice in the container.

Referring jointly to the apparatus and the process for carbonating liquids as illustrated in an exemplary embodiment of an apparatus that is diagrammatically illustrated in FIGS. 1 and 2, it will be seen that reference numeral 1 identifies a container or a so-called carbonator housing. Cooling means or evaporator tubing or coils 2 are located in the central region of the container 1, and thus divide the container 1 into an interior and an exterior region. More precisely, the interior region of the container is that portion thereof within the coil 2; the exterior region of the container is that portion thereof outside of the coil 2.

The cooling coil 2 has an inlet and an outlet connected to a source of refrigerant so that the liquid 10 within container 1 will form ice in both the interior and the exterior regions; the ice layers being formed in these regions will be hereinafter respectively referred to as the interior 13 and the exterior 12 ice layers or jackets.

The inlet and outlet portions of the cooling coils 2 are securely connected to the container 1, preferably by soldering techniques. Because the coils 2 are comparatively heavy and are generally subjected to shock and vibrations during operation, a tight connection is desirable to seal the container inasmuch as high pressures generally exist therein.

The cooling coils 2 may be helicoidially- shaped, as shown in FIGS. 1 and 2, or they may be shaped in other equivalent variations, such as spiral, conical or cylindrical configurations. In addition, each annular coil may be wound in any of the aforementioned configurations and be of round, rectilinear or oval-shaped section.

A quantity of carbonating gas, such as carbon dioxide, is admitted into the container 1 through conduit 14 by means of the valve 15. At the end of the conduit 14, a carbonator nozzle 5 admits small gas bubbles into the lower region of the container 1. The small size of the gas bubbles, which results in better dispersion and intermixing of the gas with the liquid 10, is achieved by making the nozzle 5 as a porous ceramic body. The liquid 10, which may be water with or without any additives to produce such carbonated beverages as cola-type beverages, orange drinks, lemonade drinks, champagne and the like, is admitted into the container through conduit 7 by means of the valve 16 and the mist-spraying nozzle 7'. The liquid 10 may be admitted into the central region of the container 1 or can also enter at the upper side of the exterior ice layer 12 which is, of course, a smaller peripheral area as compared with the exposed surface of the interior ice layer 13.

The mixture of gas and liquid is further mixed together by a mixing means provided in the lower region of the container 1. The mixing means comprises a rotary power unit 3, such as an electromotor or the like, having a rotating shaft and a magnetic coupling member 4' mounted on the rotary shaft exteriorly of the container 1. Within the container 1, the stirrer 4 having radially-extending blades is journalled for rotation.

Dispensing means or discharge outlet 6 is provided within container 1 to conduct, by means of valve 17, the mixture of carbonating gas, water and traces of carbonic acid away from the container 1.

Means for controlling the level of the mixture within container 1 includes electrodes 8,8' which are electrically insulated from and mounted on the container 1. The liquid-levelling electrodes 8,8' cooperate with the liquid-admitting conduit 7 to open valve 16 and add additional liquid when the discharge valve 17 has been opened and to close valve 16 in order to prevent the liquid level within the container 1 from exceeding a predetermined value.

As noted above, internal ice layer 13 is formed on the interior surface of the cooling coils 2. The admitting means 5, 7' introduce the liquid and the gas into the container so that a thermal exchange, i.e. cooling, will at least occur between the interior ice layer 13 and the mixture. In order to prevent the thickness of the interior ice layer 13 from exceeding a predetermined thickness, electrode 9, which is electrically insulated from the housing, is positioned in the container 1 away from but within the coils 2. The electrode 9 is located relatively close and adjacent to the coils 2 so that the interior ice layer 13 will have a relatively thin thickness when compared to the exterior ice layer 12. The electrode 9 which is considerably enlarged in the drawing for purposes of clarity, may be adjustably moved in the interior region adjacent the coils 2 in order to select other predetermined thicknesses. In any of such positions, it will be understood that the thickness of the interior ice layer 13 will always be thinner than the exterior ice layer 12.

As will be shown herein, as soon as the interior ice layer 13 touches or completes an electrolytic path to the electrode 9, the electrode 9 will disconnect the refrigerant supply being conducted to the interior of the coils 2. This controls the thickness of the interior ice layer 13 since the cut-off of the supply of refrigerant will eventually cause the interior ice layer to melt.

Of course, the exterior ice layer 12 is also formed simultaneously with the interior ice layer 13. The exterior ice layer 12, however, will have a relatively greater thickness as compared with the interior ice layer 13, inasmuch as more of the outer surface of the interior ice layer 13 is exposed to the relatively warmer water 10. In short, the thickness of the interior ice layer 13 is subjected to more melting or thermal erosion due to thermal interchange with the mixture 10, whereas the exterior ice layer 12 is not exposed to the warming convection effects of the mixture 10 to the same degree as the interior ice layer 13.

Safety means include an electrode 11 which is electrically insulated from the container 1 and is provided closely adjacent the interior walls of the container 1. The safety electrode 11 prevents the exterior ice layer 12 from increasing its thickness to a size where there is a danger that the exterior ice layer 12 will exert outward pressure and destroy the container. For example, such danger would exist if the electrode 9 were inoperative for any reason. FIG. 2 shows the extreme condition where the exterior ice layer has grown to such a thickness as to make electrode 11 operative.

Additional cooling means or coils 18 are provided within the first-mentioned cooling coils 2 in the container 1, and preferably concentrically therein so as to facilitate the cooling of the mixture and to improve the carbonation of the gas therein. Such additional coils 18 are operative only for those short time periods when the valve 17 is opened; thus the cooling energy lost, when portions of the mixture 10 are tapped off, are returned to the remaining mixture by the operation of the additional coils 18.

The operation of the invention is believed to be already clear from the above-given description. It is merely necessary to add that the thinner interior ice layer 13 will quickly exchange cooling energy with the mixture, whereas the thicker exterior ice layer 12 will insulate and serve to protect the interior ice layer 13 from being affacted by warmer ambient air surrounding the container. The specific heat of the exterior ice layer 12 is well known to be of a relatively large magnitude so that the exterior layer 12 can absorb and retain a great amount of cooling energy before melting.

Means other than water-levelling electrodes 8, 8′ can be utilized to control the quantity of water within the container, for example, conventional floats can be used. One especially preferable electronic means to control the admission of fresh water into the container 1 makes use of the cooperation between the water-levelling electrodes 8, 8′ with the container 1 which is grounded to serve as a complementary electrode.

Lower electrode 8 and higher electrode 8′ are located at different elevations in the container 1 so as to respectively define a minimum and a maximum water level. The electrodes 8, 8′ are each connected to two different positions of a relay switch which is in turn actuated by an electronic unit. A pump (non-illustrated) is located upstream of the conduit 7 and is also actuable by the relay switch.

In operation, when the water within the container 1 falls below the lower electrode 8 and therefore electrical current no longer flows through the water, the electronic unit senses the open circuit and actuates the relay switch to energize the pump and allow more water to be admitted through the valve 16 and conduit 7. Simultaneously, the lower electrode 8 is disconnected from the circuit, and the higher electrode is connected into the circuit by the relay switch. The water will thus continue to rise within the container 1 until the water wets the higher electrode 8′. At this point, an electrical path is again created through the water which is sensed by the electronic unit. In turn, the electronic unit activates the relay which deactivates the pump so that the flow of additional fresh water is stopped. The relay also reconnects lower electrode 8 so that the cycle may begin again.

Similarly, means other than the electrode means 9, 11 can be utilized to respectively measure the thicknesses of the interior and exterior ice layers; for example, mechanically-actuated switches can be used. One especially preferable electronic means uses Ohm's law, i.e. $V=I \times R$, as its underlying principle.

It is well known that the electrical resistance of ice is greater than that of water; hence, the different electrical conductivity of ice can be measured as a function of its thickness. Thus, electrodes 9, 11 can cooperate with the electrically-grounded container 1 and transmit variations of electrical resistance in the form of current through the water in the interior and exterior ice layers 13, 12 to respective electronic units and relay combinations which are interconnected and function in a substantially equivalent manner to that described above in connection with water-levelling electrodes 8, 8′.

However, instead of controlling a pump to admit water, the relay actuates or de-actuates a compressor-blower device which controls the admission of more or less refrigerant into the coils 2.

In operation, the respective electronic units and relays associated with electrodes 9 and 11 will always keep the latter actuated to continuously measure the electrical resistance of the interior and exterior ice layers. Should either electrode 9 or 11 indicate that the respective predetermined ice thicknesses have been reached, either one can independently shut off the compressor-blower device and stop the cooling process. This separate shut-off feature of electrode 11 is especially advantageous if electrode 9 or its associated electronic unit or its associated relay should fail for any reason and should become inoperative. It is further desirable to wire a warning device, such as a light, into the electrical circuit in order to warn a user that electrode 9 has become inoperative.

It will be understood that each of the elements described above, or two or more together, may also find a useful application in other types of constructions differing from the types described above.

While the invention has been illustrated and described as embodied in an apparatus and process for carbonating liquids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features, that from the standpoint of prior art, fairly constitute essential characteristics of the generic or specific aspects of this invention.

What is claimed as new and desired to be protected by Letters Patent is set forth in the appended claims.

1. An apparatus for carbonating liquids, particularly for carbonating beverages, comprising a container; cooling means in said container and operative for forming at the interior and the exterior of said cooling means a respective interior and exterior surrounding ice layer; first admitting means and second admitting means operative for admitting a carbonating gas and a liquid into said container for thermal contact with at least said interior ice layer so as to be cooled and mixed therein; means for dispensing the mixture from said container; and means for maintaining said interior ice layer at a thickness which is smaller than the thickness of said exterior ice layer.

2. An apparatus as defined in claim 1; and further comprising means for mixing the mixture in said container comprising a rotary power unit having a shaft, a magnetic coupling member mounted for rotation on said shaft outside said container, and a bladed stirrer mounted for rotation in said container, whereby the mixture is circulated and cooled by being constantly brought into contact by convection with said interior ice layer.

3. An apparatus as defined in claim 1, wherein said cooling means is annular and includes coils of helicoidally-shaped tubing.

4. An apparatus as defined in claim 1, wherein said cooling means is spiral-shaped.

5. An apparatus as defined in claim 1, wherein said first admitting means includes a spraying nozzle for admitting said liquid and said second admitting means including a porous ceramic nozzle for admitting said carbonating gas.

6. An apparatus as defined in claim 1; and further comprising means for controlling the level of the mixture within said container.

7. An apparatus as defined in claim 1; and further comprising additional cooling means in said container for cooling the mixture which remains after portions of the mixture containing cooling energy has been tapped off by said dispensing means.

8. An apparatus for carbonating liquids, particularly for carbonating beverages, comprising a container; cooling means in said container and operative for forming at the interior and the exterior of said cooling means a respective interior and exterior surrounding ice layer, said cooling means is connected to said container and forms a first electrode means; first admitting means and second admitting means respectively operative for admitting a carbonating gas and a liquid into said container for thermal contact with at least said interior ice layer so as to be cooled and become mixed therein to form a carbonating gas-liquid mixture; means for dispensing said mixture from said container; and means for preventing the thickness of at least said interior ice layer from exceeding a predetermined thickness, said means including second electrode means insulated from said container and cooperating with said first electrode means.

9. An apparatus as defined in claim 8, wherein said second electrode means is positioned remote from and within said cooling means so that said interior ice layer which is formed by the latter will have a thickness relatively thinner as compared with said exterior ice layer, whereby said thinner interior ice layer quickly transmits its cooling effect to the mixture and said relatively thicker exterior ice layer stores coldness and serves to insulate said interior ice layer from being affected by warmer ambient air surrounding said container.

10. An apparatus as defined in claim 8, wherein said cooling means is connected to a refrigerant supply, and wherein said second electrode means is operative for disconnecting said refrigerant supply whenever said interior ice layer exceeds said predetermined thickness.

11. An apparatus for carbonating liquids, particularly for carbonating beverages, comprising a container; cooling means in said container and operative for forming at the interior and the exterior of said cooling means a respective interior and an exterior surrounding ice layer; first admitting means and second admitting means respectively operative for admitting a carbonating gas and a liquid into said container for thermal contact with at least said interior ice layer so as to be cooled therein and become mixed to form a carbonating gas-liquid mixture; means for dispensing the mixture from said container; means for preventing the thickness of said interior ice layer from exceeding a predetermined thickness; and means including electrode means adjacent the interior wall of said container and positioned remote from and outside of said cooling means for preventing the thickness of said exterior ice layer from exceeding a pre-selected value so as to prevent the pressure exerted by said exterior ice layer from destroying said container.

12. A process for carbonating liquids, particularly for carbonating beverages, comprising the steps of providing cooling means within a container; connecting said cooling means to said container for forming first electrode means; forming an interior ice layer in said cooling means and an exterior ice layer in said container about said cooling means; admitting a carbonating gas and a liquid into the container for thermal contact with at least said interior ice layer so as to cool and mix the carbonating gas and liquid therein; dispensing the mixture from said container; and preventing the thickness of at least said interior ice layer from exceeding a predetermined thickness, said step of preventing including insulating a second electrode means from said container.

13. A process as defined in claim 12; and further comprising the step of positioning said second electrode means remote from and within said cooling means so that said interior ice layer which is formed by the latter will have a thickness relatively thinner as compared with said exterior ice layer, whereby said thinner interior ice layer quickly transmits its cooling effect to the mixture and said relatively thicker exterior ice layer stores coldness and serves to insulate said interior ice layer from being affected by warmer ambient air surrounding said container.

14. A process as defined in claim 12; and further comprising the step of connecting said cooling means to a supply of refrigerant, and wherein said step of preventing includes disconnecting said refrigerant supply whenever said interior ice layer exceeds said predetermined thickness.

15. A process for carbonating liquids, particularly for carbonating beverages, comprising the steps of providing cooling means within a container; forming an interior ice layer in said cooling means and an exterior ice layer in said container about said cooling means; admitting a carbonating gas and a liquid into the container for thermal contact with at least said interior ice layer so as to cool and mix the carbonating gas and liquid therein; dispensing the mixture from said container; preventing the thickness of at least said interior ice layer from exceeding a predetermined thickness; and protecting said container from possible destruction caused by pressure being exerted outwardly by said exterior ice layer.

16. A process for carbonating liquids, particularly for carbonating beverages, comprising the steps of providing cooling means within a container; forming at the interior and the exterior of said cooling means a respective interior ice layer and exterior ice layer; admitting a carbonating gas and a liquid into the container for thermal contact with at least said interior ice layer so as to cool and mix the carbonating gas and liquid therein; dispensing the mixture from said container; and maintaining said interior ice layer at a thickness which is smaller than the thickness of said exterior ice layer.

17. A process as defined in claim 16, wherein said step of admitting includes spraying said liquid into said container, and wherein said step of admitting said carbonating gas includes admitting said gas in fine bubbles by means of a porous ceramic nozzle.

18. A process as defined in claim 16; and further comprising the step of controlling the level of the mixture within said container.

19. A process as defined in claim 16; and further comprising the step of additionally cooling the remaining mixture within said container after portions of the mixture containing cooling energy have been tapped off by said dispensing step.

20. A process as defined in claim 16; and further comprising the step of mixing the mixture in said container by magnetically coupling a rotary power unit to a bladed stirrer.

21. A process as defined in claim 16; and further comprising the step of coiling the cooling means into an annular helicoidal configuration.

22. A process as defined in claim 16; and further comprising the step of coiling the cooling means into a spiral shape.

* * * * *